United States Patent [19]

Assal et al.

[11] 4,267,538

[45] May 12, 1981

[54] RESISTIVELY MATCHED MICROWAVE PIN DIODE SWITCH

[75] Inventors: François T. Assal, Bethesda; Arnold L. Berman, Kensington; Khodadad Betaharon, Rockville, all of Md.

[73] Assignee: Communications Satellite Corporation, Washington, D.C.

[21] Appl. No.: 99,814

[22] Filed: Dec. 3, 1979

[51] Int. Cl.[3] ..... H01P 1/15; H01P 3/08; H01P 1/26

[52] U.S. Cl. ..... 333/262; 333/33; 333/246

[58] Field of Search ..... 333/101, 103, 104, 164, 333/156–157, 160–161, 258, 262, 245–247, 33–35, 32

[56] References Cited

U.S. PATENT DOCUMENTS 4,078,217 3/1978 Beno ..... 333/262

*Primary Examiner*—Marvin L. Nussbaum

*Attorney, Agent, or Firm*—Sughrue, Rothwell, Mion, Zinn and Macpeak

[57] ABSTRACT

A microwave PIN diode switch is provided with circuitry to achieve impedance matching at both input and output ports and for both "on" and "off" switching states.

5 Claims, 11 Drawing Figures

RESISTIVELY MATCHED MICROWAVE PIN DIODE SWITCH

BACKGROUND OF THE INVENTION

This invention relates to microwave PIN diode switches, and more particularly to a technique for providing impedance matching in such switches.

PIN diodes consist of heavily doped $p^+$ and $m^+$ end regions separated by a lightly doped region which can usually be regarded as intrinsic. If this center region is thick, e.g., 10–100 microms, the device is useful as a high-voltage rectifier with a low forward drop at high currents because of the conductivity modulation of the i region by the large number of carriers injected from the end regions. It is also known to use the PIN diode as a variable resistance at microwave frequencies. Because of the relatively long recovery time of the i layer, microwave frequencies will be too high for rectification to occur. At zero or reverse bias the intrinsic layer will represent a high resistance and, under forward bias, the injection and storage of carriers reduces the resistance of the intrinsic region to a very low level. These diodes can be used as microwave switches when driven with abrupt bias changes.

FIG. 1*a* shows a PIN diode having an anode 10 and a cathode 12. FIG. 1*b* shows the equivalent circuit of the PIN diode of FIG. 1*a*. The RF resistance $R_D$ of the PIN diode is a nonlinear resistance which varies as a function of the applied bias. The effective resistance of $R_D$ can vary from 0.5 ohms at full forward bias to 10 k ohms at zero bias.

Shown in FIG. 2 is a schematic diagram of a conventional reflective type microwave PIN diode switch. In order to permit the passage of RF power, the PIN diodes 14 and 16 should be reverse biased so that they represent open circuits. This is accomplished by supplying a negative potential at the DC bias input terminal. The DC bias is isolated from the RF signal by the $\lambda/4$ transmission line 18 which represents a short circuit for the DC bias current and an open circuit for the RF signal. The equivalent circuit for the switch of FIG. 2 when the PIN diodes are reverse biased is shown in FIG. 3*a*. A signal propagating along a transmission line having a characteristic impedance $Z_0$ will encounter a $\lambda/4$ transmission line 20 having an impedance $Z_0$ and the $\lambda/4$ transmission line 18 having an impedance $Z_1$ with $Z_1 >> Z_0$. Due to the its reflective RF termination through capacitor 19, the transmission line 18 will represent an open circuit to the RF signal and, consequently, the RF signal will effectively see only the $\lambda/4$ transmission line 20 with impedance $Z_0$. The RF signal will propagate through the transmission line 20 and appear at the output of the switch. Since the input and output impedances of the switch are substantially $Z_0$, impedance matching is achieved at both the input and output ports of the switch and the RF signal will propagate through the switch with little or no reflection.

When the conventional switch in FIG. 2 is used to block the RF signal, the diodes 14 and 16 are forward biased to represent short circuits on either side of the switch. This is accomplished by providing a positive DC bias signal through the $\lambda/4$ transmission line 18. The equivalent circuit of the switch of FIG. 2 and its RF "off" condition is shown in FIG. 3*b*. The diodes 14 and 16 are forward biased to represent approximately 0.5 ohms across the transmission path and the RF power on either side of the switch will be reflected by the severe impedance mismatch.

In some applications, this reflected RF energy could have a significant adverse effect on the surrounding circuitry. For example, in an $8\times8$ Microwave Switch Matrix (MSM), eight different RF input signals are simultaneously supplied to respective 8-way power dividers so that each RF input port is coupled to a respective row in an $8\times8$ array of power divider ports. At the output of the MSM are eight RF ports each connected to a respective 8-way power divider in a similar fashion as the input ports, and the output power dividers are arranged orthogonally to the input dividers. The 64 power divider ports are coupled through an $8\times8$ array of 64 PIN diode switches, so that any one of the eight RF input ports can be connected to any one of the eight RF outputs.

If conventional microwave switches such as shown in FIG. 2 are used in such a MSM, the "off" switches will reflect the RF energy back through the power dividers and the reflected RF energy will interfere with the RF signal at the corresponding input port. It has been discovered that this reflective energy will produce large insertion loss variations with frequency and an insertion loss scattering from path-to-path which are difficult to control over a wide frequency band. These insertion loss variations with frequency distort the communication signals of high capacity Time Division Multiple Access (TDMA) carriers and produce intersymbol interference. Further, in Satellite Switched Time Division Multiple Access (SS-TDMA) operation, the insertion loss scattering from path-to-path would require adaptive gain control at the eight outputs of the MSM in order to insure a constant transmitted energy within a SS-TDMA frame.

SUMMARY OF THE INVENTION

Accordingly, it is an object of this invention to eliminate the necessity of adaptive gain control circuits and to minimize the signal degradation caused by intersymbol interference.

Briefly, this is accomplished according to the present invention by providing additional circuitry at the input and output of a conventional microwave PIN diode switch so that impedance matching is accomplished at both input and output ports and for both "on" and "off" switching states. In the preferred embodiment of the invention, the RF input is supplied to the conventional PIN diode switch through a DC blocking capacitor and a $\lambda/4$ $Z_0$ impedance transmission line. Connected across the RF transmission path at a point between the DC blocking capacitor and the additional $\lambda/4$ $Z_0$ impedance transmission line are an additional PIN diode serially coupled to the parallel connection of a $\lambda/4$ $Z_1$ transmission line and a resistor having a resistance $R_0$ substantially equal to the impedance $Z_0$. The same circuitry is connected to the output side of the microwave PIN diode switch. In its RF "on" condition the switch effectively presents three serially connected $\lambda/4$ $Z_0$ impedance transmission lines, and, therefore, impedance matching is provided at both the input and the output ports. In its RF "off" condition, the switch will essentially present a $R_0$ termination at both its input and output so that impedance matching is substantially maintained.

DETAILED DESCRIPTION OF THE PREFERRED EMBODIMENT

Figure 4:
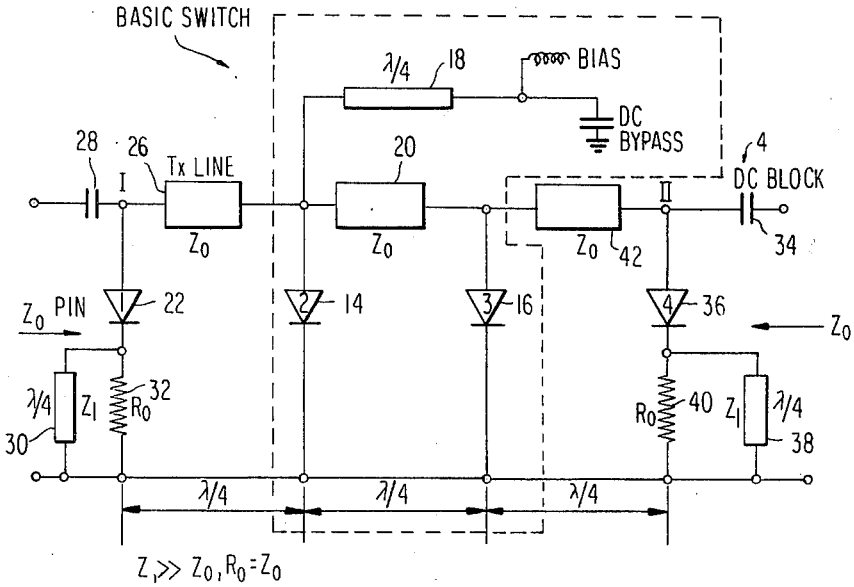
FIG. 4 is a schematic diagram of a resistively matched microwave PIN diode switch according to the present invention.

FIG. 4 is a circuit diagram of a resistively matched microwave PIN diode switch according to the present invention. The portion of the switch within the dotted line is a conventional reflective type PIN diode switch such as that shown in FIG. 2. The additional circuitry and the switch according to the present invention comprises, at both the input and output ports, a DC blocking capacitor, a $\lambda/4$ transmission line connected between the capacitor and the conventional PIN diode switch and having an impedance $Z_0$, an additional PIN diode having its cathode connected to the junction of the capacitor and $\lambda/4$ transmission line, a resistance $R_0$ approximately equal to $Z_0$ connected in series with the PIN diode across the two conductors of the RF transmission path, and, finally a $\lambda/4$ transmission line connected in parallel with the resistance $R_0$ and having an impedance $Z_1$ which is much greater than the characteristic impedance $Z_0$ of the transmission path.

Figure 1A:
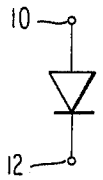
FIGS. 1*a* and 1*b* illustrate a PIN diode and its equivalent circuit, respectively.
Figure 1B:
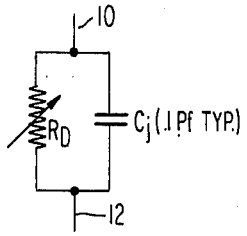
Figure 2:
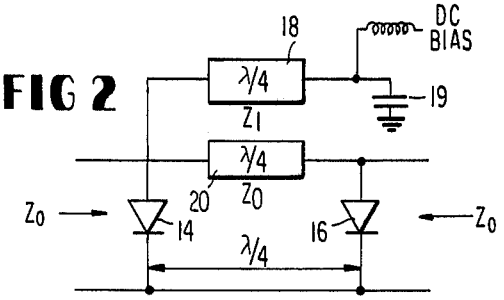
FIG. 2 is a schematic diagram of conventional reflective type microwave PIN diode switch.
Figure 3A:
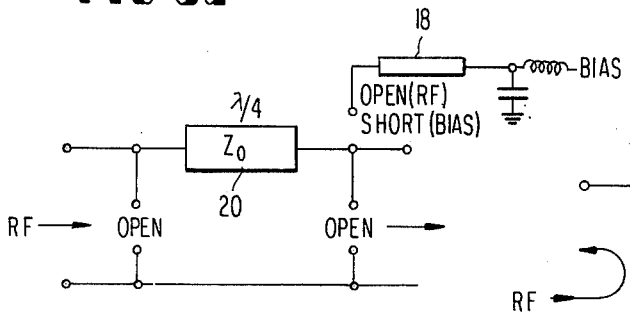
FIGS. 3*a* and 3*b* are the equivalent circuits of the switch of FIG. 2 in its RF "on" and RF "off" conditions, respectively.
Figure 3B:
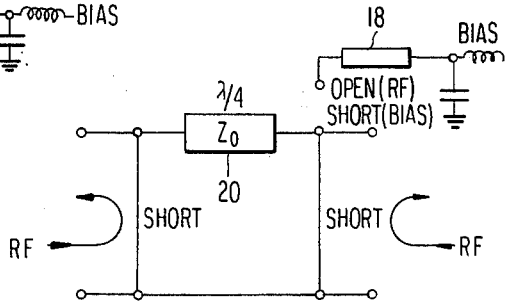
Figure 5A:
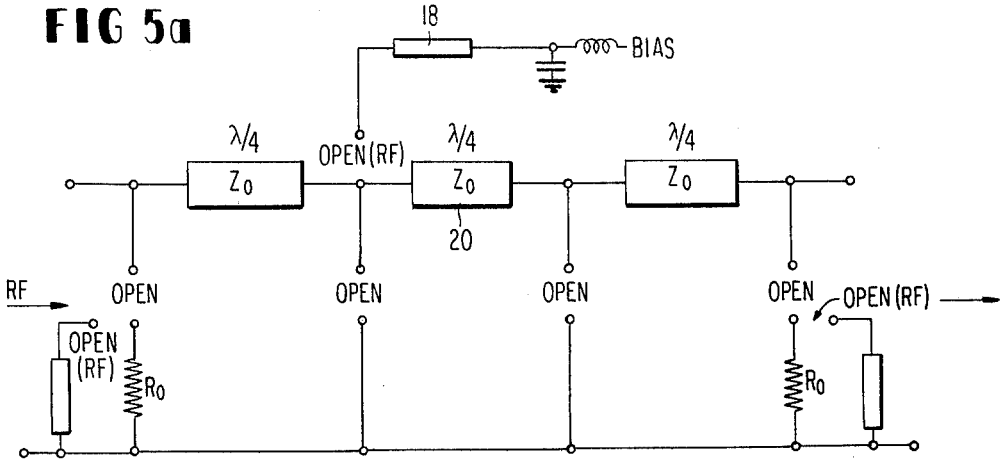
FIGS. 5*a* and 5*b* are equivalent circuits of the switch of FIG. 4 in its RF "on" and RF "off" conditions respectively.
Figure 5B:
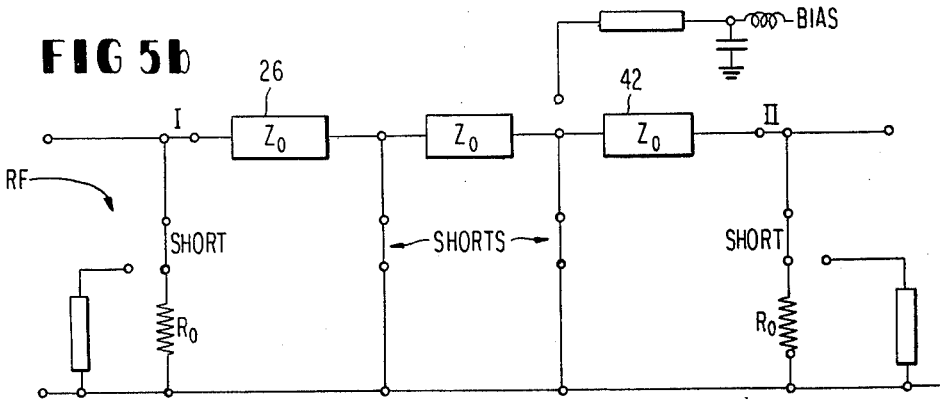

In the RF "on" state the operation of the resistively matched switch of FIG. 4 is substantially the same as that of a conventional reflective type switch shown in FIG. 2. A reverse bias applied to each of the PIN diodes will result in each of the PIN diodes effectively representing an open circuit to the RF signal so that the signal will be passed from the input to the output terminals along a path which maintains an impedance of substantially $Z_0$. The equivalent circuit as seen by the RF signal for the "on" state of the switch of FIG. 4 is shown in FIG. 5*b*.

The significant advantage of the switch of FIG. 4 is its impedance matching in the "off" condition of the switch. As in the conventional switch, the "off" condition is obtained by supplying a DC bias signal through the high impedance $\lambda/4$ transmission line 18. Also as in the conventional switch, a $\lambda/4$ transmission line having a reflective termination will represent an open circuit to the RF signal and, therefore, the transmission line 18 will pass only the DC bias. The forward biasing of the diodes 14 and 16 in addition to the additional PIN diodes 22 and 36 will result in a substantial short circuiting of the RF transmission path on either side of the transmission line 20 as in the conventional switch. In the resistively matched switch, however, the following results are also obtained.

1. The short circuiting of diode 14 will provide a reflective termination to the transmission line 26. Thus, the RF signal passed by the DC blocking capacitor 28 will see the transmission line 26 as an open circuit.

2. The $\lambda/4$ transmission line 30 will also represent an open circuit to the RF signal. Accordingly, an RF signal entering the switch input will see only the resistor 32 having a resistance $R_0$ which is substantially the same as the characteristic impedance $Z_0$ of the RF transmission path. Consequently, little or no reflection will occur.

The DC blocking capacitor 34, PIN diode 36, $\lambda/4$ high impedance transmission line 38, resistor 40 and $\lambda/4$ transmission line 42 coupled to the output of the switch operate in the same fashion as described above for the corresponding components at the switch input. The equivalent circuit as seen by the RF signal for the "off" condition of the switch is shown in FIG. 5*b*. Note that each of the $\lambda/4$ transmission lines 26 and 42, as seen by the RF signal at the input and output ports respectively, terminates in a reflective short circuit and, therefore, will represent an open circuit to the RF signal. Further, the high impedance $\lambda/4$ transmission lines 30 and 38 will likewise represent open circuits to the RF signal, so that RF signals at either side of the switch will only see a terminating resistance $R_0$ which is substantially matched to the impedance $Z_0$ of the RF transmission path.

The purpose of the high impedance $\lambda/4$ transmission lines 30 and 38 is to provide a path for the DC bias current. In the absence of these additional transmission lines, the bias current would have to flow through the load resistances $R_0$ connected in series with each of the PIN diodes 22 and 36, thus resulting in an undesirable power dissipation. By providing these additional high impedance transmission lines, the DC bias current path, for example, for PIN diode 22, comprises transmission lines 18, 26 and 30 as well as the diode 22. While each of these transmission lines represents an impedance to the RF signal, the resistance to DC current is negligible.

Figure 6:
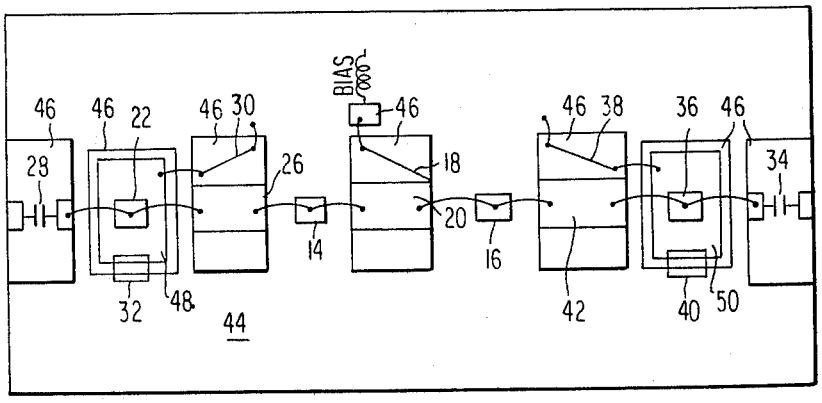
FIG. 6 is a plan view of one example of a suitable physical construction of the circuitry shown in FIG. 4.

Shown in FIG. 6 is one example of a suitable printed circuit structure for the circuitry of FIG. 4. The entire switch is fabricated on a metal carrier 44 and various areas of insulation 46 separate the circuit components from the metal carrier. The PIN diodes 14 and 16 have their anodes wire bonded to the microstrip $\lambda/4$ transmission lines 20, 26 and 42 and their cathodes are coupled to the metal base 44. The anodes of PIN diodes 22 and 36 are similarly wire bonded to the transmission lines 26 and 42, and their cathodes are in contact with metal layers 48 and 50, respectively, which metal layers are separated from the metal base by insulation 46. Resistors 32 and 40 are formed between the cathodes of diodes 22 and 36 and the metal base 44, and wire bonds are used to couple the cathodes of these additional PIN diodes to the high impedance $\lambda/4$ DC return lines 30 and 38.

Figure 7:
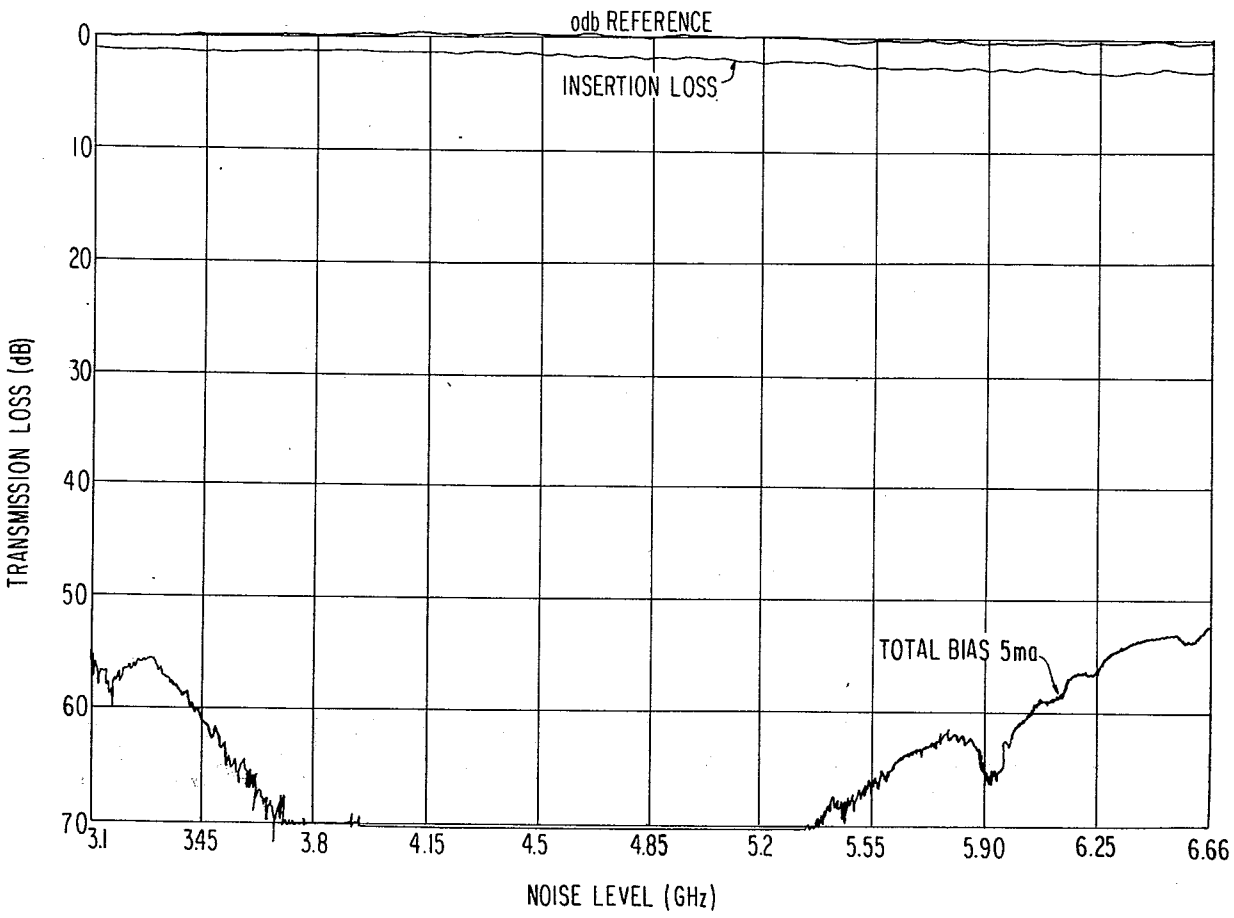
FIG. 7 is a graph of the insertion loss for both "on" and "off" conditions of the switch shown in FIG. 4.

FIG. 7 is a graph of the insertion loss of the resistively matched switch according to the present invention. In the RF "on" condition the insertion loss is represented by curve 50 in FIG. 7 and it is apparent that the loss is very low. In the RF "off" condition the insertion loss is indicated by the curve 52 in FIG. 7. The curve indicates that over a relatively wide band with approximately 3.8 to 5.25 GHz, a total bias current of 5 ma will result in substantially no signal being present at the output of the switch. Thus, the isolation provided by the resistively matched switch is quite good, and is a significant improvement over the conventional reflective type switch in which the isolation provided by the "off" switch condition would be in the range of 50 db. A large part of this increased isolation may be attributable to the open circuits presented by the $\lambda/4$ transmission lines 26 and 42 on either side of the switch.

Figure 8:
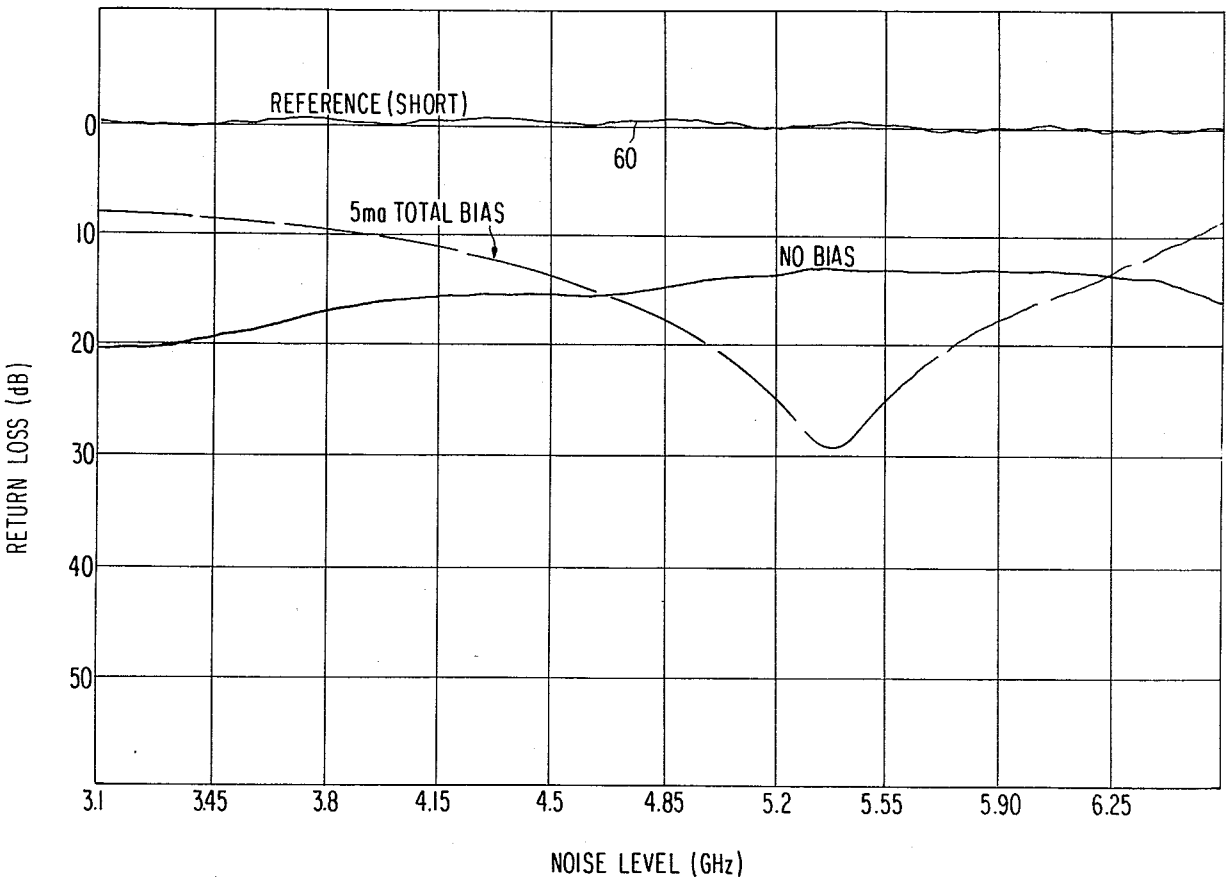
FIG. 8 is a graph of the return loss of the switch shown in FIG. 4.

FIG. 8 illustrates the return loss of the resistively matched switch. The return loss is a measure of the impedance mismatch which occurs at the junction between the RF transmission path and the switch. If the switch were non-existent, i.e., if the switch were replaced by a pair of short circuits connecting the corresponding input and output terminals, there would be no impedance mismatch and this is designated by the 0 dB line 60 in FIG. 8. For no applied DC bias or a 5 ma total bias, the impedance mismatch is generally less than 20 dB, and the "worst case" is less than 30 dB. This is obviously an improvement over the conventional reflective type switch in which the RF transmission path is faced with a rather abrupt short circuit at the switch in its "off" condition. This substantial improvement of the impedance mismatch will significantly reduce the reflected RF power which will, in turn, reduce the intersymbol interference. Further, the insertion loss over a relatively wide frequency band can be substantially neglected, thus eliminating the necessity of adaptive gain control at the outputs of a microwave switch matrix.

What is claimed is:

1. A microwave PIN diode switch of the type having an input port comprising first and second input terminals, an output port comprising first and second output terminals, a first reflecting PIN diode coupled between said first and second input terminals and means for supplying a controllable bias signal to said first reflective PIN diode to switch said diode between conductive and nonconductive states, said switch receiving a RF signal from first and second RF transmission conductors of a RF transmission path of impedance $Z_0$ and either passing said RF signal to said output port or reflecting said output signal in accordance with the applied bias, the improvement comprising:

impedance matching means connected between said RF transmission path and said first reflective PIN diode for presenting an impedance of substantially $Z_0$ to said transmission path regardless of the conductive state of said first reflective PIN diode, said impedance matching means comprising a first impedance matching PIN diode and a first impedance matching resistor connected in series between said first and second input terminals, said resistor having a resistance value $R_0$ substantially equal to the impedance $Z_0$.

2. A microwave PIN diode switch as defined in claim 1 wherein said impedance matching means further comprises a $\lambda/4$ transmission line of impedance $Z_0$ connected between said first impedance matching and first reflecting diodes and in series with said first RF transmission conductor.

3. A microwave PIN diode switch as defined in claim 2, wherein said impedance matching means further comprises a $\lambda/4$ transmission line of impedance $Z_1$ greater than $Z_0$ connected in parallel with said first impedance matching resistor.

4. A microwave PIN diode switch as defined in claim 3, wherein said impedance matching means further comprises a DC blocking capacitor connected in series between said first RF transmission conductor and the connection point between said PIN diode and said first $\lambda/4$ transmission of impedance $Z_0$.

5. A microwave PIN diode switch as defined in any one of claims 1 or 2–4, wherein said switch further comprises a second reflecting PIN diode connected between said first and second output terminals and a $\lambda/4$ transmission line connected in series with said first RF transmission conductor and between said first and second reflecting PIN diodes, the improvement further comprising:

a second impedance matching means identical to said first impedance matching means and coupled between said first and second output terminals in the same manner as said first impedance matching means is connected to said first and second input terminals.

* * * * *